US009200464B1

(12) United States Patent
Blake et al.

(10) Patent No.: US 9,200,464 B1
(45) Date of Patent: Dec. 1, 2015

(54) UNIVERSAL SAFETY DRAIN AND METHOD

(75) Inventors: Andy F. Blake, Phoenix, AZ (US); Samuel J. Sutton, III, Phoenix, AZ (US)

(73) Assignee: Shasta Industries, Inc., Phoenix, AZ (US)

( * ) Notice: Subject to any disclaimer, the term of this patent is extended or adjusted under 35 U.S.C. 154(b) by 981 days.

(21) Appl. No.: 12/135,426

(22) Filed: Jun. 9, 2008

Related U.S. Application Data

(63) Continuation-in-part of application No. 11/440,478, filed on May 25, 2006, now abandoned.

(51) Int. Cl.
*E04H 4/00* (2006.01)

(52) U.S. Cl.
CPC ..... *E04H 4/00* (2013.01)

(58) Field of Classification Search
USPC ..... 4/507, 510, 511, 512, 608, 668, 679; 52/11; 405/48, 119; 210/167.1, 167.16, 210/163–166
See application file for complete search history.

(56) References Cited

U.S. PATENT DOCUMENTS

| | | | | |
|---|---|---|---|---|
| 149,373 | A * | 4/1874 | Clapp | 210/163 |
| 4,322,860 | A | 4/1982 | Gould | 4/490 |
| 4,492,491 | A * | 1/1985 | Lunden et al. | 405/119 |
| 5,341,523 | A * | 8/1994 | Barnes | 4/507 |
| 5,365,617 | A | 11/1994 | Tarr | 4/508 |
| 5,408,706 | A * | 4/1995 | Barnes | 4/507 |
| 5,458,769 | A * | 10/1995 | Johannessen | 210/163 |
| 5,734,999 | A | 4/1998 | Nicholas | 4/507 |
| 6,022,481 | A | 2/2000 | Blake | 210/776 |
| 6,170,095 | B1 | 1/2001 | Zars | 4/507 |
| 6,280,639 | B1 | 8/2001 | Ortiz | 210/776 |
| 6,397,408 | B1 | 6/2002 | Veloskey et al. | 4/504 |
| 6,810,537 | B1 * | 11/2004 | Barnes et al. | 4/507 |
| 6,817,043 | B2 * | 11/2004 | Zars | 4/504 |
| 6,971,588 | B1 | 12/2005 | Tarr et al. | 239/204 |
| 7,089,607 | B2 | 8/2006 | Barnes et al. | 4/508 |
| 2004/0175311 | A1 * | 9/2004 | Cormier | 422/265 |
| 2006/0015996 | A1 * | 1/2006 | Goettl | 4/507 |
| 2006/0117680 | A1 * | 6/2006 | Dill et al. | 52/169.7 |
| 2006/0230514 | A1 * | 10/2006 | Meincke | 4/507 |
| 2007/0180605 | A1 * | 8/2007 | Griffin et al. | 4/507 |

* cited by examiner

*Primary Examiner* — Lauren Crane
(74) *Attorney, Agent, or Firm* — Cahill Glazer PLC

(57) ABSTRACT

A swimming pool safety drain including a base having a bottom, and having end walls and side walls extending upwardly from the bottom to form an open top enclosure. A cover is removably secured to the enclosure and, when secured to the enclosure forms an inlet slot about the periphery thereof. A plurality of drain outlets are formed in the base for connection to water recirculating systems for the swimming pool and any supplemental water recirculating system. A safety bridge is secured in the enclosure between the side walls and is positioned over the drain outlets to provide hair and limb entrapment protection. A construction cover is provided to temporarily replace the permanent cover during construction and installation of the drain.

2 Claims, 7 Drawing Sheets

UNIVERSAL SAFETY DRAIN AND METHOD

CROSS-REFERENCE TO RELATED APPLICATION

This application is a continuation-in-part of a patent application entitled "ANTI-ENTRAPMENT, ANTI-VORTEX SAFETY DRAIN" filed May 25, 2006, now abandoned and assigned Ser. No. 11/440,478.

FIELD OF THE INVENTION

The present invention pertains to swimming pool drains, and particularly to swimming pool drains that are configured to provide protection against limb and hair entrapment. The invention is also directed to swimming pool drains that permit the increased flow rates resulting from added water features frequently accompanying swimming pools while maintaining protection against entrapment.

BACKGROUND OF THE INVENTION

This invention relates to swimming pools and more particularly to swimming pool drains that are designed to prevent entrapment while accommodating high water flow volume that may be encountered in modern swimming pools. Pool water circulating systems circulate and filter significant quantities of water; water is removed from the main drains and delivered to filtering systems and subsequently reintroduced into the pool. Various pool systems have incorporated many variations on this circulation system; however, several problems have persisted. The problem of limb and hair entrapment has become increasingly important especially with the advent of greater flow volume resulting from the frequent need to supplement the pool recirculation system with added water features such as water fountains or spas.

Prior art pool designs have frequently attempted to overcome these difficulties by the incorporation of multiple drains; that is, a single pool main drain is replaced by two or more drains separated by a predetermined minimum distance. In this manner, a swimmer coming in contact with one of the drains and creating what otherwise would be a serious or fatal drain contact, will merely cause the flow rate through the remaining or uncovered drain to increase. The swimmer would thus be able to release themselves from contact with the main drain. The inclusion of multiple drains, however, incorporates significant additional costs in the manufacture of a pool and particularly increases the cost of pool installation.

The addition of supplemental water features such as spas and the like significantly contribute to the difficulty encountered with the use of single drains. The added requirement for water flow volume caused by the added features increases the flow volume through the drain thus significantly increase the difficulties concerning entrapment.

SUMMARY OF THE INVENTION

The present invention provides a safety drain that incorporates several features rendering the drain applicable to most installations, accommodating increased water volume flow, while presenting substantial anti-entrapment characteristics. A base is formed having a bottom, end walls and side walls that form an open top enclosure; a cover is removably secured to the enclosure and, when installed, forms an input slot about the periphery of the cover to permit water from the pool to enter the enclosure. A plurality of drain outlets are formed in the bottom of the base for connection to the pool water recirculation system and to any supplemental water recirculation system that may be serviced by the safety drain. Typically, this supplemental water recirculation system will be added to service a spa. A safety bridge is strategically placed in the enclosure between the walls and over the drain outlets. The positioning and length of the safety bridge provides unique anti-entrapment features that prevent entrapment even if the cover of the safety drain were removed. Limbs are prevented from gaining access to the drain outlets when the safety drain cover is removed. With the cover in place, anti-hair entrapment is enhanced by the utilization of the safety bridge. That, in combination with the provision of strictly controlled input and output areas of the drain, prevent hair entrapment by requiring the path to be taken by hair strands to be tortuous and maintain out of contact with high velocity flow typically existing at the drain outlet. The safety drain of the present invention is provided with specifically chosen materials to provide ultraviolet radiation protection while providing an economical drain construction. The safety drain is also formed using a method for selectively choosing the structure of the drain for use with a vinyl lined pool or for a concrete pool having other surface treatments such as plaster. The drain of the present invention is also provided with a construction cover that is removably installed for use during the installation of the drain and may be reinstalled during such installation to protect the drain from debris and other foreign materials.

BRIEF DESCRIPTION OF THE DRAWINGS

The present invention may more readily be described by reference to the accompanying drawings in which.

DETAILED DESCRIPTION OF THE INVENTION

Figure 1:
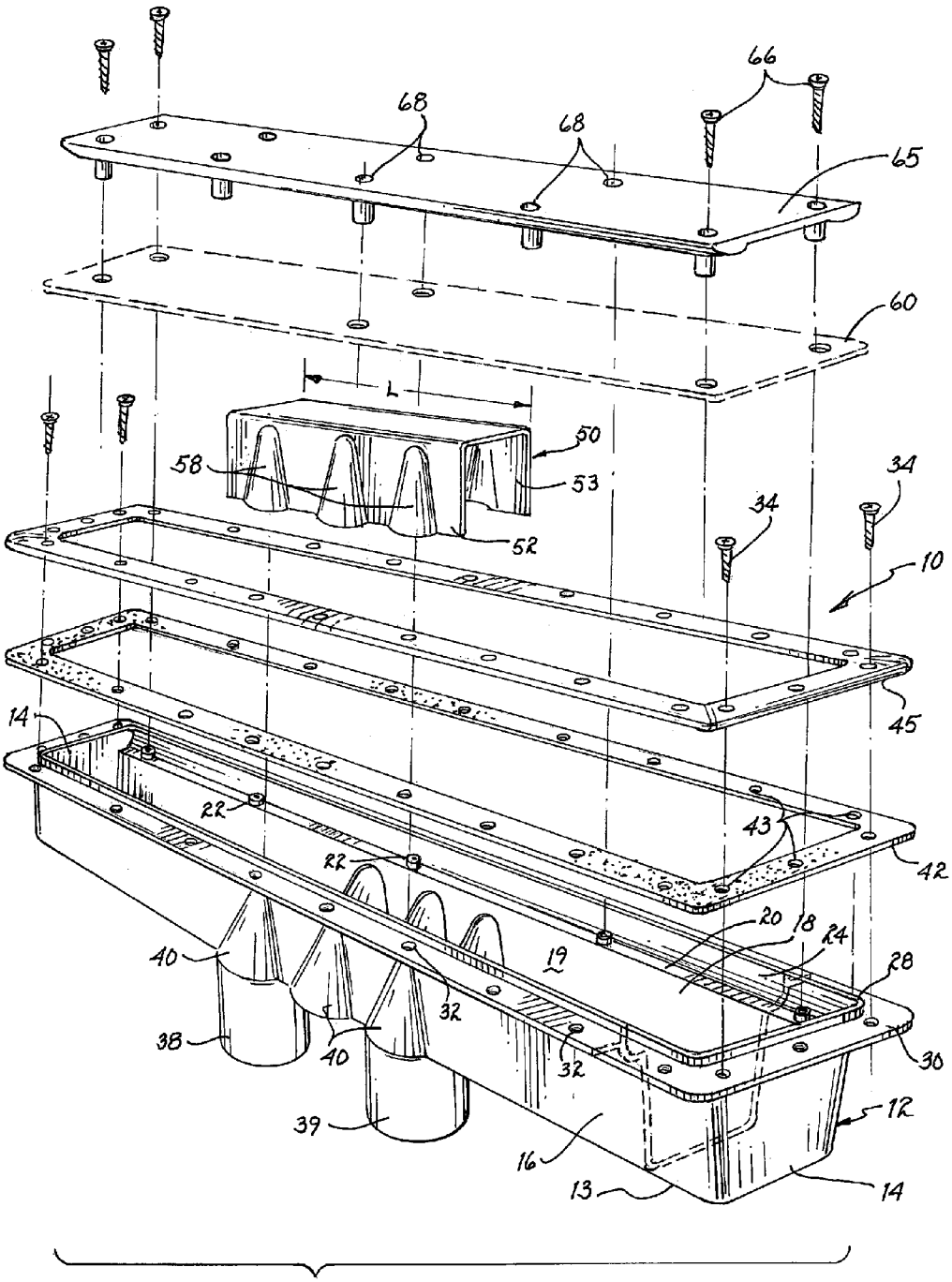
FIG. 1 is an exploded perspective view of a safety drain constructed in accordance with the teachings of the present invention.

FIG. 1 is an exploded view of a safety drain 10 constructed in accordance with the teachings of the present invention. The drain incorporates a base 12, having a bottom 13, end walls 14 and having sidewalls 16 and 18 forming an open top enclosure 19 for receiving water from the pool. The sidewalls are upwardly diverging and form a horizontally extending support ledge 20. The ledge includes upwardly extending stanchions 22 strategically placed along the ledge. The walls continue past the ledge to upwardly curved lips 24 and 26 terminating in a vertically extending circumscribing rim 28. The walls continue from the rim 28 to a circumscribing horizontally extending flange 30. The flange is provided with a plurality of holes 32 to admit flange screws 34 for securing other portions of the drain. The base is formed of one-piece plastic material except for the drain attachments or fittings 38 and 39 which may be separately formed and subsequently cemented in place as shown. The upwardly extending sidewalls 16 and 18 include cone-shaped positioning keyways 40 extending outwardly from the sidewall to receive corresponding mating keys to be described. The material with which the base is formed may conveniently be an acrylonitrile butadiene styrene (ABS) plastic resin. This material provides sufficient strength and has appropriate characteristics for molding in the configuration shown. It may be noted that when the base is placed in a pool with the cover in place, it will be continuously covered during its lifetime and therefore need only minimum ultraviolet inhibitors.

The drain includes a gasket 42 for mounting on the horizontally extending flange 30 and is provided with appropriate holes 43 to permit the flange screws to pass therethrough. A frame 45 is positioned over the gasket and is secured in place to the base through the use of flange screws engaging the corresponding holes provided therefor in the horizontally extending flange.

A safety guard or safety bridge 50 is provided and may be molded of the same ABS material as the base, and includes sidewalls 52 and 53 having mating cone-shaped keying surfaces 58 for engaging the keyways 40 in the sidewalls of the base. When the safety bridge or guard 50 is to be permanently mounted within the base, the keying surfaces are coated with an appropriate cement and the safety bridge snapped into place with the keys mating with the corresponding keyways. When thus mounted, the safety guard or safety bridge forms a correctly positioned permanent portion of the safety drain. Note that the length L of the safety bridge is chosen so that the bridge extends over all of the outlet openings in the bottom of the safety drain. This length is chosen so that the shortest water flow path from the inlet slot, to be described, to the outlet is greater than the shortest straight line distance between the inlet and outlet. If hair from a swimmer is drawn into the inlet of the safety drain, the hair will be maintained with minimum contact with the highest flow rate occurring at the drain outlet. To create this distance that the hair must travel to reach the high flow rate area, the safety bridge is positioned over the outlets and is of sufficient length to make the hair travel a tortuous path before it reaches the high velocity section of the safety drain. In this manner, hair that may be drawn into the safety drain from a swimmer will have to travel a longer path from the drain inlet slot before it reaches a higher flow rate area that may cause entrapment. Thus, even though the safety drain of the present invention may easily handle high flow rates required by the pool and supplemental systems, safety is maintained by ensuring that flow rates being encountered by swimmers will be maintained at a safe level and hair that is entrained into the safety drain is maintained a further distance from the high flow rate outlet of the drain. To ensure that the flow rate be encountered by swimmers at the safety drain surface is at a safe level, the total area of the inlet slot is greater than the area of the outlets.

During installation, when the base is placed in the bottom of a pool under construction, a temporary construction cover 60 is provided and is temporarily secured in place by removable plastic fasteners extending through openings provided therefor in the construction cover and extending into and engaging the appropriate stanchions molded in the base. This construction cover 60 prevents debris and other foreign materials from entering the base during the construction phase of pool installation, and also shields the base from the deleterious effects of ultraviolet radiation during exposure thereto while the pool is being constructed. When the appropriate time presents itself for completing the installation, the construction cover is simply removed by manually forcing the fasteners out of the corresponding stanchions and peeling the construction cover back to be removed and discarded. The above mentioned safety guard or safety bridge may then be installed and permanently cemented within the base and the cover 65 may then be attached to the base through the utilization of cover screws 66 extending through openings 68 provided in the cover and engaging corresponding stanchions 22 molded in the base. In some cases, it may be desirable to temporarily replace the construction cover during installation of the safety drain. The plastic fasteners are reusable to permit the cover to be positioned as shown and then reattached by pushing the used plastic fasteners into corresponding passageways in the stanchions.

The cover 65 is not permanently mounted on the base and may be removed for a variety of reasons during the lifetime of the drain such as for servicing, cleaning, etc. Thus, the cover screws 66 will be removed and replaced during the lifetime of the drain; in view of the fact that the materials being secured (the cover and the base) are made of plastic, it is important that the cover screws facilitate frequent removal and reattachment. To permit such reattachment without deleteriously affecting the fastening forces required to maintain the cover in place, inserts, to be described, are provided in the stanchions for engagement with the cover screws. The cover screws will normally be provided with tamper-proof keyed heads to prevent tampering or removal by unauthorized personnel.

The cover 65 is constructed of a plastic material having predetermined physical characteristics including significant UV resistance, or inhibitors added or contained therein. The cover will be exposed to UV radiation throughout its lifetime and therefore must be able to withstand the weathering effects of such radiation. Accordingly, an acrylonitrile styrene acrylate (ASA) is chosen for the material with which the cover is constructed. ASA is an acrylate rubber modified styrene acrylonitrile copolymer with an acrylate rubber modifier included at the polymerization stage. The higher UV resistance of the ASA cover permits the drain to be exposed over its lifetime to sunlight and otherwise damaging UV radiation; however, the added cost attendant the utilization of ASA material is minimized in the present drain construction through the combined use of ASA and ABS in strategically chosen portions of the drain. The end result is a drain that can be economically produced while nevertheless providing excellent UV resistance throughout its expected lifetime.

Figure 2:
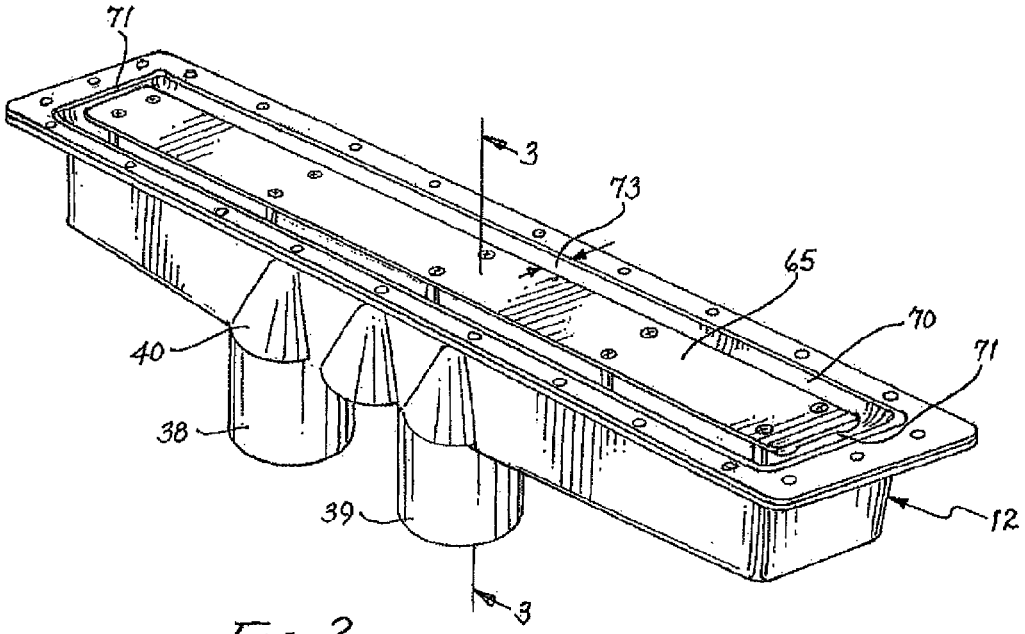
FIG. 2 is a perspective view of the safety drain of FIG. 1 shown in its assembled condition.
Figure 3:
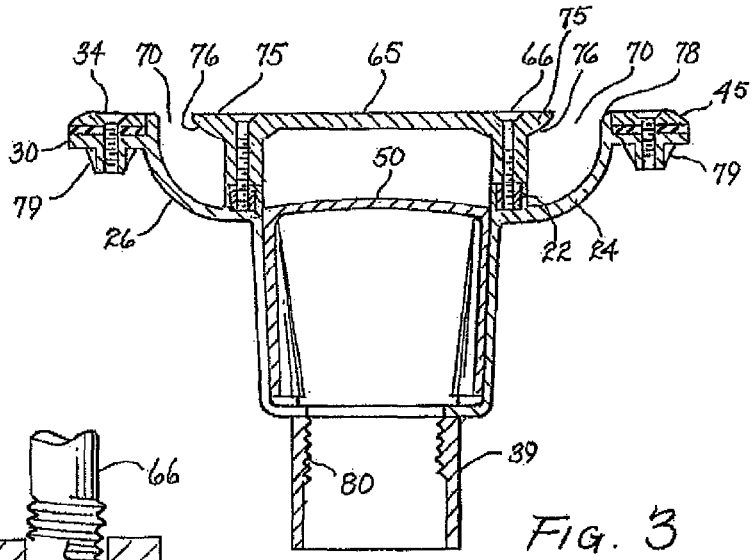
FIG. 3 is a cross-sectional view of the safety drain of FIG. 2 taken along line 3-3.

FIGS. 2 and 3 illustrate the assembled safety drain constructed in accordance with the teachings of the present invention. It may be noted that the cover 65 is rectangular and has been secured in place through the utilization of cover screws 66 entering the supporting stanchions 22 that extended upwardly from the base. When the cover is in place, an inlet slot 70 is formed about the periphery of cover 65 to permit water to enter the enclosure. The input slot 70 thus formed provides a continuous unobstructed opening to the drain interior and a smoothly curved passageway to the interior of the drain. In some instances, it may be desirable to eliminate the end portions 71 of the input slot thus creating two halves of the input slot each extending parallel to a long side of the rectangular cover. The opening, or aperture 73, provided by the slot to incoming water is at least 0.75 inches. If end portions 71 are eliminated, it is important to maintain the total area of the slot greater than the total area of the output drains.

The input, formed as described, also provides the added benefit of preventing the accumulation of debris on the input surface of the drain. For example, debris such as leaves is typically trapped against the drain which may clog the drain and create a strain on the pool pump. The structure of the safety drain of the present invention enables such debris to be drawn into the drain, out of the pool, and directed to a leaf trap commonly found in pool recirculation systems. The safety guard or safety bridge cannot be seen in FIG. 2 but it has been positioned and secured permanently through the utilization of the above mentioned cement. FIG. 3 is a cross-section of the safety drain of FIG. 2 taken along line 3-3. Referring to FIG. 3 it may be seen that the upwardly curved lips 24 and 26 form a smooth entrance passageway to water flowing into the base; similarly, the cover 65 is provided with curved ribs 75 to present a corresponding curved surfaces 76 to water passing through the inlet between the lip and the cover. It may be noted that the edges 78 of the upwardly curved lips are rounded or radiused to prevent the existence of any sharp edges to thus inhibit the inadvertent capture of limbs or fingers being trapped in the inlet. It may also be noted by reference to FIG. 3 that bosses 79 are integrally formed underneath the flange to provide support for the addition of the flange screws 34 to secure the frame 45 to the flange.

The drain fixture 39 is shown incorporating internal threads 80; these threads are utilized for the temporary insertion of a plug (not shown) that is placed in the drain during installation to prevent debris or other foreign materials from entering any drain pipe that is to be connected to the fixture. Drain pipes, sometimes referred to as drain risers, that are to be connected to the safety drain at the drain fixtures 39 would normally be cemented to the fixtures using an appropriate cement for permanently securing the drain pipe (normally a PVC material) to the ABS material of the drain fixture.

When the cover 65 is positioned as shown in FIGS. 2 and 3 an inlet slot 70 formed about the periphery of the cover 65 provides a generally rectangular pattern on the face of the safety drain. The inlet slot provides a smooth water passageway into the safety drain while presenting curved and smooth surfaces to prevent limb or hair entrapment. It may be noted that the entrance edges 78 of the inlet slot are chamfered or appropriately rounded and no protrusions or sharp features are present thus inhibiting entrapment even in the event of curious invasion by the fingers of a person or child. The area of the inlet slot is maintained greater than the area of the drain fittings and drain pipes. Maintaining the relationship will ensure that the water velocity flowing into the safety drain through the inlet slot will be maintained at a lower velocity than the water flowing out of the safety drain through the drain fittings into the PVC riser. The maximum permissible flow rate that may be a design criteria will thus always occur at the safety drain outlet in a location remote from the inlet to maintain the anti-entrapment characteristics of the safety drain.

Figure 3A:
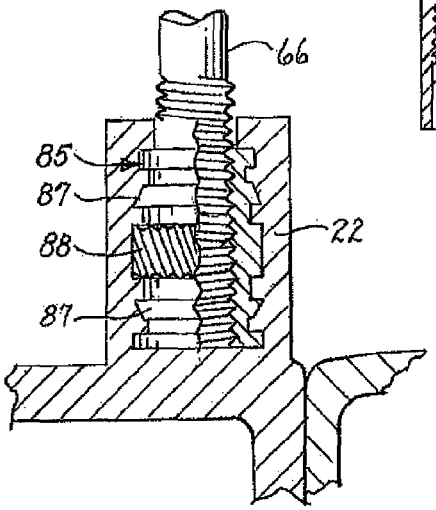
FIG. 3A is an enlarged view of a portion of the cross-section of FIG. 3 showing inserts used to receive the cover screws.
Figure 4A:
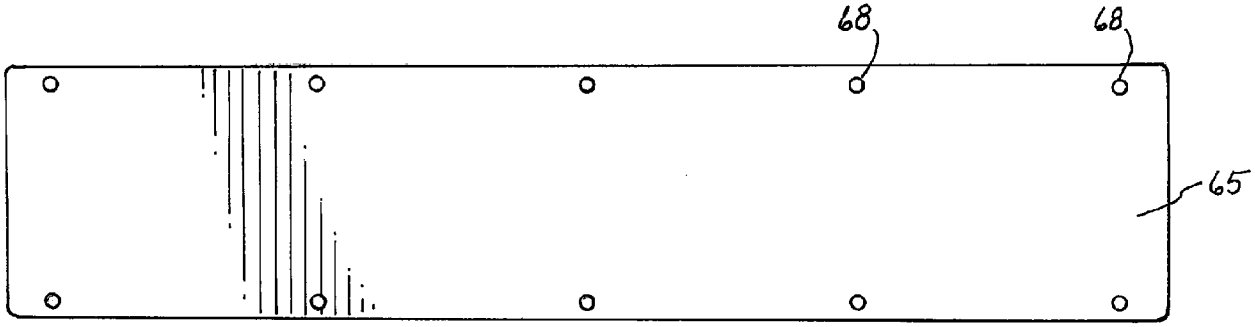
FIGS. 4A, 4B, 4C and 4D are top, side, bottom and end views, respectively, of the cover of the safety drain of FIG. 1.
Figure 4B:
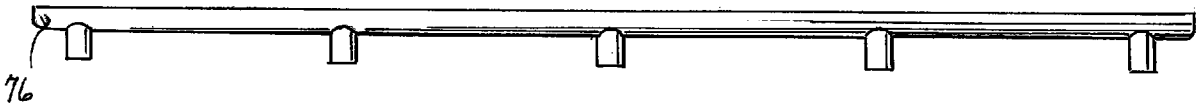
Figure 4C:
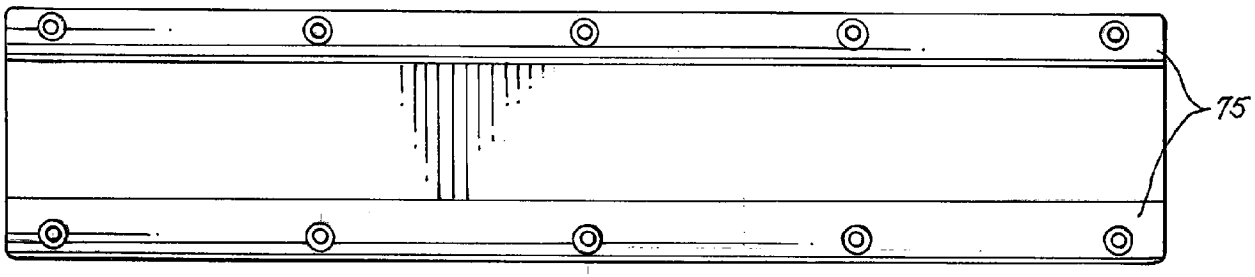
Figure 4D:
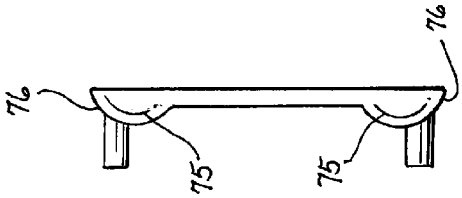

The cover 65 may be removed by removing the cover screws 66 to permit access to the interior of the drain to perform maintenance or retrieve objects that may have been drawn into the drain. The cover may then be reinstalled by appropriately positioning the cover and fastening the screws. This removal and reinstallation of the cover frequently results in undue wear to the threads that may be contained in the stanchions; therefore, the present invention incorporates a plurality of threaded inserts positioned in corresponding stanchions. Referring to FIG. 3A, a sample stanchion 22 is shown, greatly enlarged and in cross-section, to show the positioning of an insert 85. The insert may be made of brass and will include circumferential ridges 87 to prevent axial movement of the insert once placed in the stanchion. Each insert includes a circumferential band 88 that is knurled so that the band engages the plastic of the stanchion and prevents rotation of the insert about its longitudinal axis. The interior of the insert is bored and threaded to receive a corresponding cover screw. Thus, the cover may be removed by removing the corresponding cover screws and may be replaced several times throughout its expected lifetime without concern for the ability of the screws to properly fix the cover in place to prevent inadvertent removal or accidental dislodgement. In this regard, and as described above, it may be noted that the cover screws are typically headed with a unique configuration that will require a special tool for removal to prevent unauthorized access to the interior of the drain.

Referring to FIGS. 4A, 4B, 4C, and 4D, the cover of the safety drain of FIG. 1 is shown in greater detail. The figures are illustrations of the top, side, bottom and end of the cover, respectively. It may be seen that the cover 65 incorporates holes 68 to admit cover screws with positioning of the screws, and screw holes, corresponding to the stanchions extending upwardly from the base of the drain as shown in FIG. 1. It may be noted by reference to the bottom of the cover, FIG. 4C, that a pair of longitudinally extending ribs 75 are positioned adjacent each side edge of the cover. An end view of these ribs may be seen by reference to FIG. 4D wherein it may be noted that the ribs 75 are formed by longitudinally extending right circular cylinder surfaces and wherein the radius of curvature of the surface is greater than 0.75 inches. The curved surfaces 76 of these longitudinally extending ribs cooperate with the interior curved surface of the upwardly curved lips of the base to present a smooth configuration for the efficient flow of water and, importantly, to present non-hair or limb entrapment surfaces to a swimmer who happens to engage the surface of the safety drain.

Figure 5:
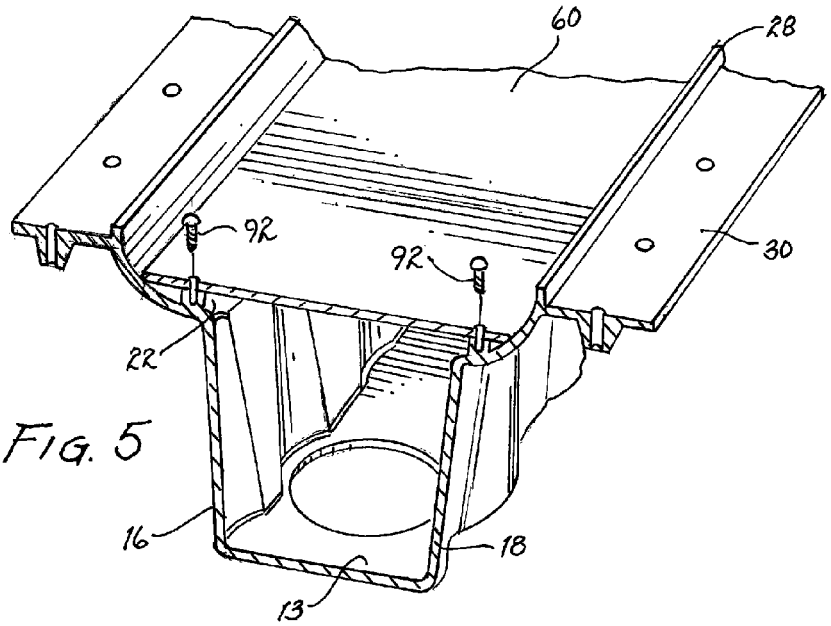
FIG. 5 is a partial cross-sectional view of the safety drain of the present invention illustrating the mounting and dismounting of the construction cover.
Figure 6:
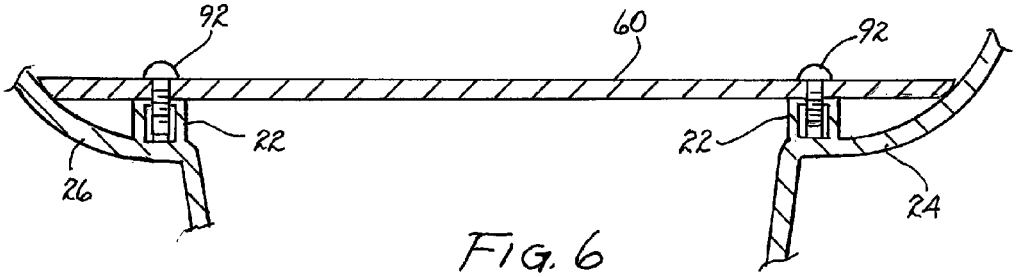
FIG. 6 is an enlarged cross-sectional view of a portion of FIG. 5 showing the mounting of the construction cover in place.

Referring now to FIGS. 5 and 6, a cross-sectional view of a portion of the safety drain of FIG. 1 is shown illustrating the utilization of the construction cover. It may be seen that the construction cover 60 may be formed of a suitable, inexpensive, plastic material that is temporarily secured over the opening to the base of the safety drain. The construction cover may be temporarily secured through the utilization of removable and reusable plastic snap fittings 92 that are inserted and pushed into the stanchions 22; the fasteners are readily removed by simply grasping the cover and lifting the cover to release the temporary grip provided by the plastic fasteners. It may be noted that the utilization of the construction cover permits the base to be installed and left in an incompleted installation configuration while nevertheless preventing dirt and debris from entering the drain. It may also be noted that the construction cover may be replaced if it had temporarily been removed. To provide continuing protection to the interior of the drain base the plastic fasteners may simply be replaced and pushed into position as shown in FIG. 6. The cover may subsequently be removed or reinstalled depending on the conditions present during the drain installation procedure.

Figure 7:
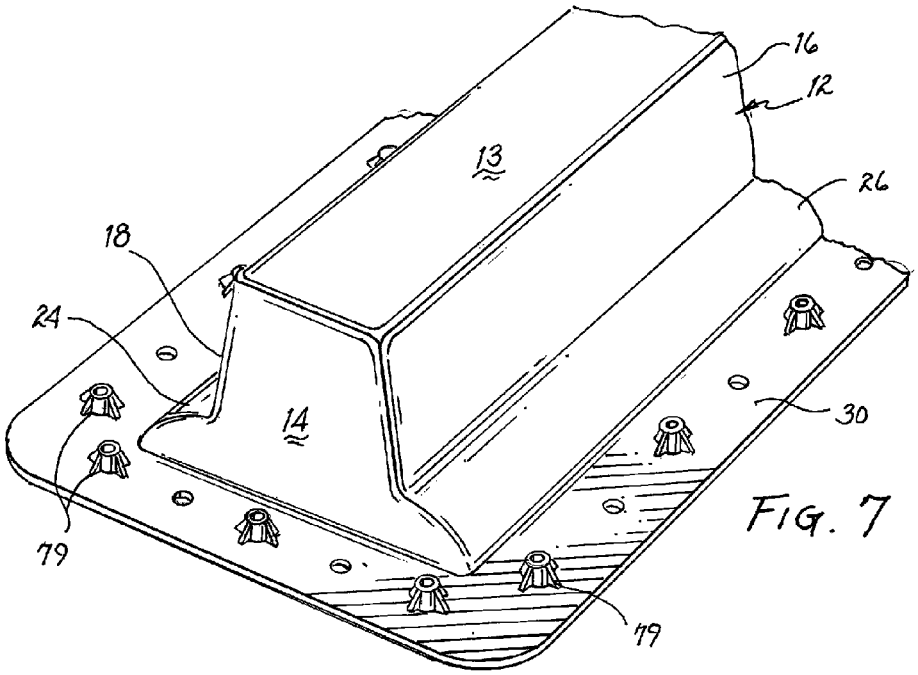
FIG. 7 is a partial perspective view of the bottom of the safety drain of FIG. 1.

Referring to FIG. 7, a perspective view of a portion of the bottom of the safety drain base of FIG. 1 is shown. It may be noted that the drain is formed in a single piece with diverging sidewalls 16 and 18 that form the base with a bottom 13 and end walls 14. Molded plastic bosses 79 are provided in the flange to permit the insertion and threading of flange screws. The bottom of the upwardly extending curved lips 24 and 26 are clearly shown in FIG. 7 as is the horizontally extending support flange 30 shown in FIGS. 5 and 6 with the vertically extending circumscribing rim 28.

Figure 8:
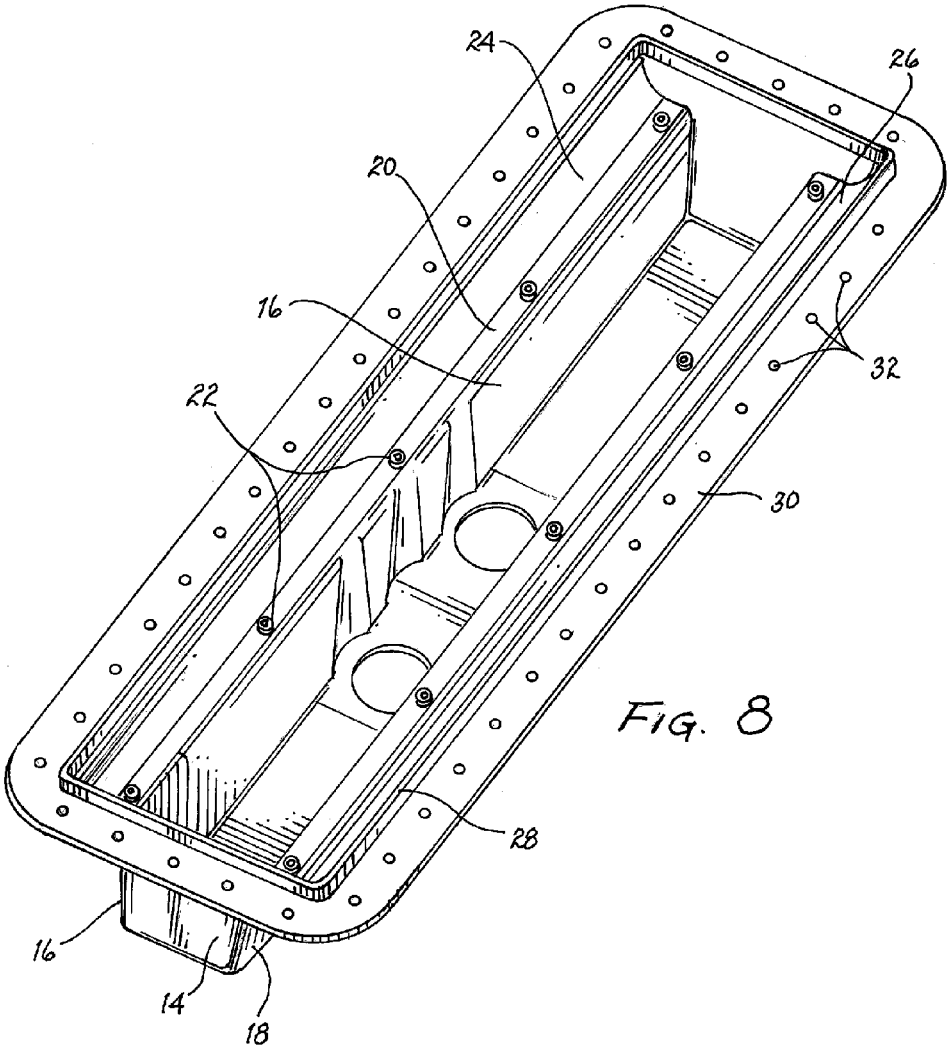
FIG. 8 is a perspective view of a portion of the safety drain of FIG. 1 illustrating the interior of the drain to show structural details.

Referring to FIG. 8, the safety drain of FIG. 1 is shown without the cover, safety guard or safety bridge, frame or gasket. FIG. 8 clearly illustrates the diverging upwardly extending side walls 16, 18 and the horizontally extending support ledge 20 provided with a plurality of upwardly extending stanchions 22 to accept cover screws. FIG. 8 also clearly illustrates the upwardly curved lips 24 and 26 terminating in the vertically extending circumscribing rib 28 and the horizontally extending flange 30 provided with a plurality of holes 32 to accept flange screws.

Figure 9:
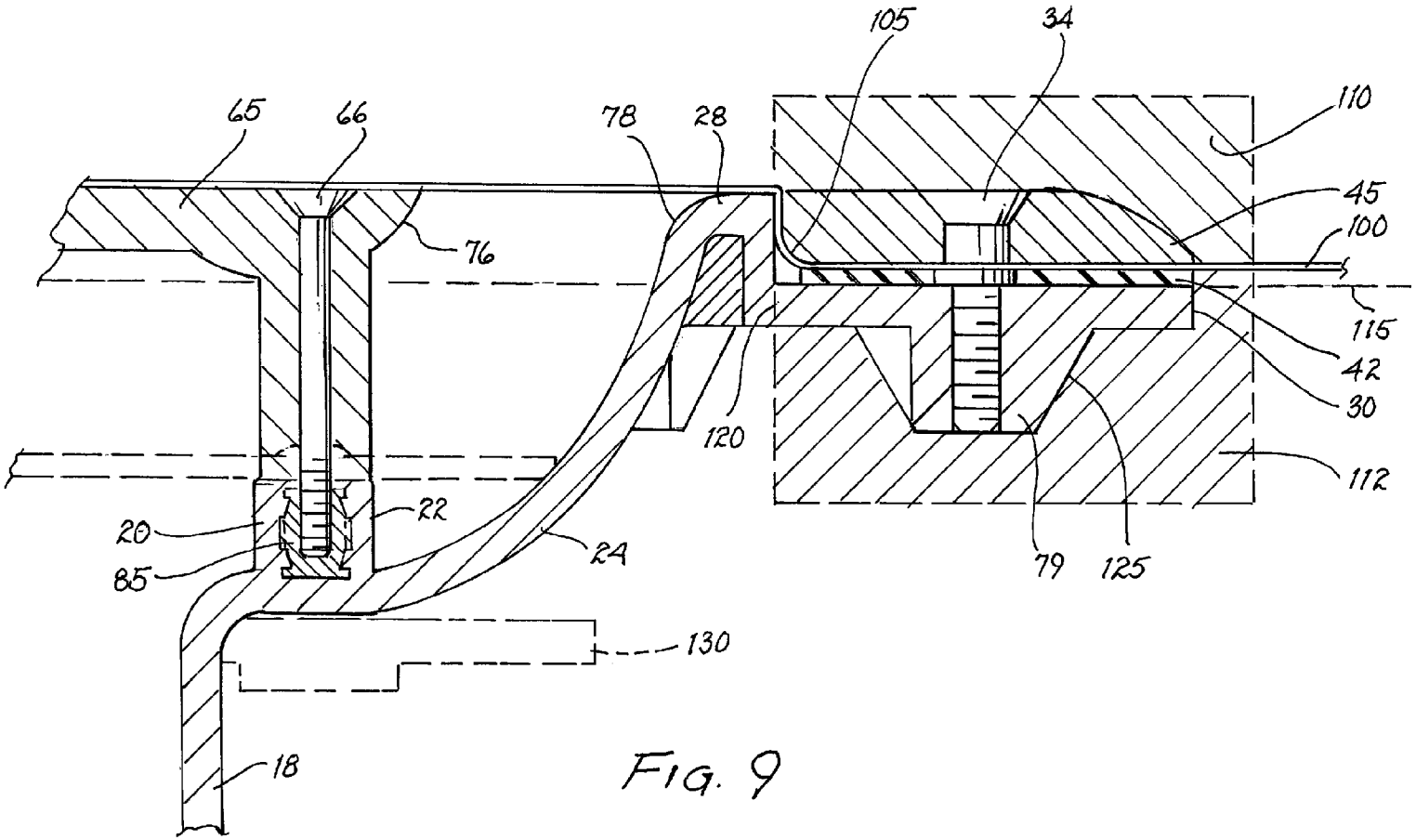
FIG. 9 is a cross-sectional view if a portion of the safety drain illustrating the details of formation of the safety drain for use in a vinyl-lined pool and alternatively for use in a concrete plastered pool.

Referring to FIG. 9, the cross-sectional view of a portion of the safety drain of FIG. 1 is shown. The sidewall 18 is shown extending upwardly to the horizontally extending support ledge 20 having the stanchions 22 formed integrally therewith. The insert 85 is shown molded into the stanchion, while the cover screw 66 is shown extending through the cover 65 into the stanchion in contact with the insert to secure the cover in place. The upwardly curved lip 24 is shown terminating in the vertically extending circumscribing rim 28 which continues to form the horizontally extending flange 30. The reinforcing boss 79 formed integrally with the flange is shown to receive and accept a flange screw 34. It may be noted that the interior edge 78 of the upwardly curved lip is radiused to present a smooth flow path for incoming fluid and, in combination with the curved surface of the cover rib 76 presents an anti-limb and hair entrapment configuration. The embodiments thus far described present a safety drain that is configured for utilization with a vinyl-lined pool. Accordingly, in FIG. 9, a vinyl lining 100 is shown as it would appear during installation of the lining in the pool. The vinyl 100 is trapped between the gasket 42 and the frame 45 and extends around the radiused curve 105 of the inner edge of the frame and the radiused or chamfered edge of the lip 24 as it passes over the opening provided in the drain. During installation, after the vinyl has been properly installed, the portion of the vinyl overlying the drain is removed such as by cutting along the outline of the drain to remove the overlying portion of the vinyl lining.

The drain of the present invention is also applicable to concrete pools having a plaster or similar lining. Under such circumstances, it is not necessary to provide the horizontally extending flange 30 and the lining or coating, such as plaster, is simply spread or troweled up to and level with the upper edge of the drain. The drain of the present invention is formed using well known plastic injection molding techniques. The molds for the drain may be adapted to produce either the vinyl-lined pool configuration or the concrete pool configuration. To provide this versatility by using a single mold, it may be noted in FIG. 9 that a mold insert portion is utilized to form the horizontally extending flange 30 and is in two parts: a top mold insert 110 and a bottom mold insert 112. The bottom mold insert 112 includes a cavity 125 to receive fluidized plastic material for forming the flange portion of the drain. The part line 115 is the junction between the upper and lower mold inserts. These mold inserts are placed in the master mold to receive the injected fluidized material and to cause the formation of the drain having the horizontally extending flange. In the event that the drain is to be utilized for a concrete pool without the vinyl lining, the mold inserts are removed and replaced with a solid insert not having the cavity provided for the formation of the flange. As a result of this solid or blank insert, the safety drain is formed without the flange and terminates at 120 that provides an abutting lip to which concrete and plaster are placed during the installation of the drain.

When the safety drain is utilized with a concrete pool, it is frequently desirable to include a water stop structure attached to or forming a part of the safety drain. Such water stops are intended to prevent leaks from occurring at the junction of the plaster and the safety drain. Vinyl lined pools usually do not require such water stops since the vinyl lining is attached to and is grasped by the safety drain between the flange 30 and the frame 45; the gasket 42 provides a water-tight seal at the grasping surfaces. In concrete pools, there is no vinyl lining that can form a water seal with the safety drain. A water stop 130 shown in phantom lines in FIG. 9 may be secured to the drain in any convenient fashion such as cementing to the side wall and/or the bottom of the upwardly extending curved lips of the safety drain.

Figure 10:
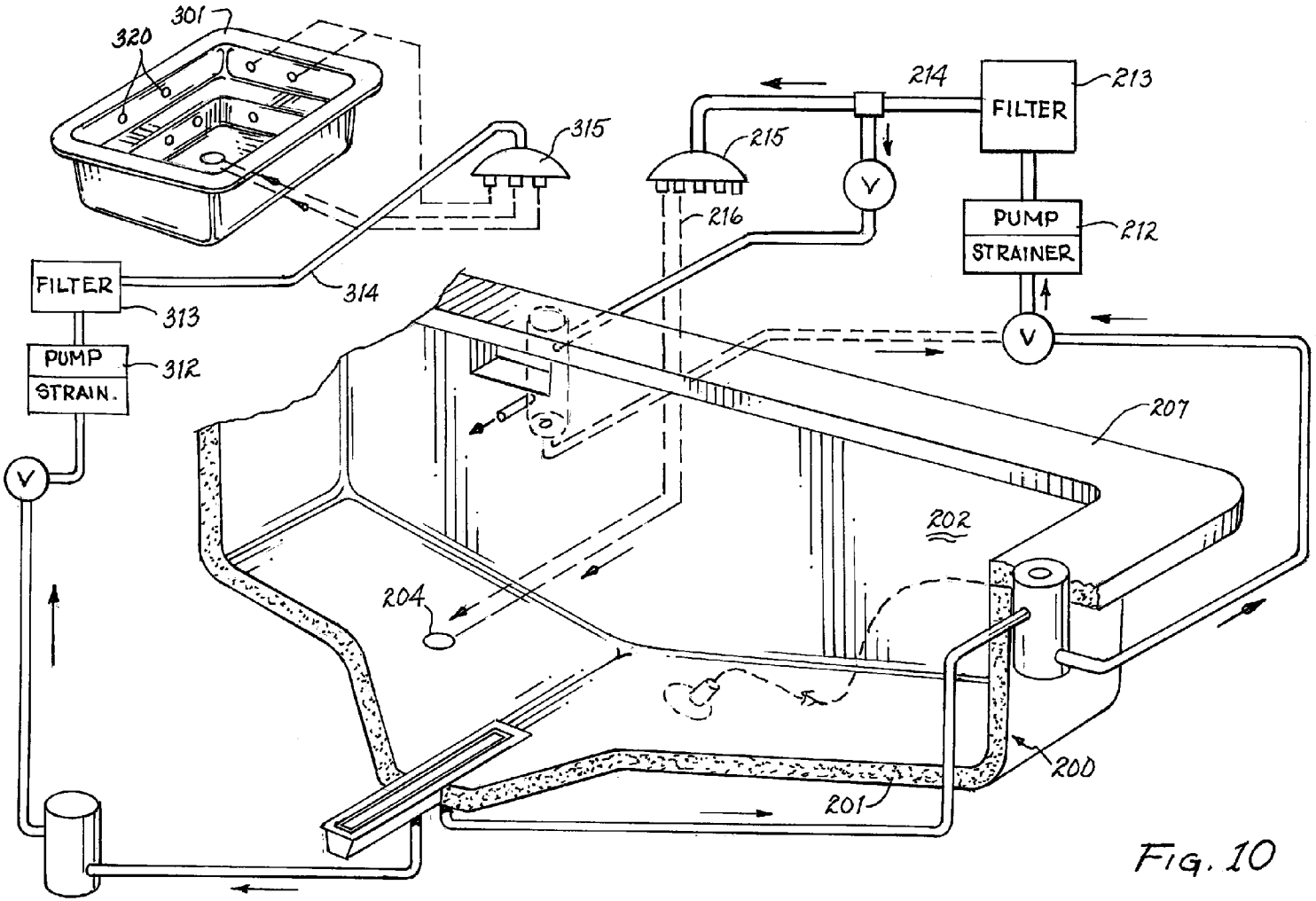
FIG. 10 is a schematic illustration of a pool water recirculating system incorporating the safety drain of the present invention useful in illustrating the utilization of the safety drain to service a swimming pool as well as a supplemental water circulating system represented by a spa.

The safety drain of the present invention thus provides a drain for connection to multiple water features that include, in addition to the recirculating water in the swimming pool, other water features such as fountains, water displays, spas and the like. The multiple drain connections of the safety drain of the present invention permit the interconnection of these different water systems while providing the safety inherent in the safety drain design. The implementation of the multiple drain feature of the safety drain of the present invention is shown in an example in FIG. 10. Referring to FIG. 10, a swimming pool 200 is shown including a bottom 201 and inner walls 202 surrounded by a conventional pool deck 207 and further including an integrated pool cleaning system. The pool cleaning system may include a pump 212 having its high pressure outlet coupled to the inlet of a filter 213. The outlet of filter 213 is connected by pipe 214 to an inlet of a distribution valve 215 having various distribution outlet ports each connected to one or more pop-up heads 204 disposed in the bottom 201 of the swimming pool. Other cleaning systems may be incorporated and provisions for such systems may include additional fittings and delivery pipes to provide water under appropriate pressure to those features. In the embodiment shown in FIG. 10, only one such connection between a distribution outlet of distribution valve 215 is shown and is indicated by the dashed line 216.

A secondary water recirculation system, such as a spa 301, may have a separate pump 312 similar to the pool pump 212. This secondary system also includes a filter 313 coupled to pump 312 working in a similar fashion to that pool pump 212 and filter 213. Pipe 314 transports water to a distribution valve 315, and depending on the type of secondary system, valve 315 may take many forms. In this described embodiment, the separate water recirculation system provided to the spa 301 includes multiple jets 320. A return pipe (not shown in FIG. 10) to the main pool allows a mixed water source with the pool 200.

Thus, the safety drain of the present invention may be utilized to provide a return path for water not only to the swimming pool system itself, but to secondary recirculation systems such as the spa described above. The recirculation of water in these systems is accomplished through the safety drain of the present invention while presenting a single drain for inclusion during the construction process and without requiring separate return drains requiring additional plumbing and construction cost. Although a single drain is used, the safety features of the drain provide protection against limb and hair entrapment while permitting sufficient volume flow through the single safety drain to accommodate more than one recirculating pump which in turn provides appropriate recirculation for both the swimming pool and one or more additional features such as fountains, spas and the like.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A swimming pool safety drain comprising:

(a) a base having a bottom and having end walls and upwardly diverging sidewalls extending therefrom to form an open top enclosure, said sidewalls including at least one upwardly extending positioning keyway therein to receive a mating key;

(b) a cover having a periphery, said cover removably secured to said enclosure forming an input slot about said periphery between said cover and said walls to permit water to enter the enclosure from the pool;

(c) a drain outlet formed in the bottom of said base for connection to a low pressure side of a swimming pool pump of a pool recirculation system;

(d) a safety bridge mounted in said enclosure between said sidewalls and positioned over said drain outlet, said safety bridge extending for a predetermined horizontal length, said predetermined horizontal length creating water flow from any point at said input slot to said drain outlet that is a greater distance than a straight line from said point to said drain outlet;

(e) the total area of said input slot greater than the total area of said outlet to maintain a water flow rate at said input lower than water flow rate at said outlet;

(f) said safety bridge including a downwardly extending keying surface mating with the respective keyway of said sidewalls and insertable in said enclosure between said sidewalls with said keying surface contacting said keyway to position said safety bridge over said drain outlets; and (g) wherein said upwardly extending positioning keyway is cone shaped and extends outwardly from a sidewall, and wherein said safety bridge keying surface is cone shaped and is insertable and snappable into place in the enclosure between the sidewalls with the keying surface mating with the keyway;

whereby said safety bridge may be cemented in place to become a permanent portion of the safety drain.

2. A swimming pool safety drain comprising:

(a) a base having a bottom and having end walls and upwardly diverging sidewalls extending therefrom to form an open top enclosure, said sidewalls including upwardly extending positioning keyways therein to receive mating keys;

(b) a cover having a periphery, said cover removably secured to said enclosure forming an input slot about said periphery between said cover and said walls to permit water to enter the enclosure from the pool;

(c) a plurality of drain outlets formed in the bottom of said base for connection to a swimming pool recirculation system;

(d) a safety bridge mounted in said enclosure between said sidewalls and positioned over said drain outlets, said safety bridge extending for a predetermined horizontal length, said predetermined horizontal length creating water than point at said input slot to a drain outlet that is a greater distance than a straight line from said point to said drain outlet;

(e) the total area of said input slot greater than the total area of said outlet to maintain a water flow rate at said input lower than water flow rate at said outlet;

(f) said safety bridge including plural downwardly extending keying surfaces mating respective keyways of said sidewalls and insertable in said enclosure between said sidewalls with said keying surfaces contacting said keyways to position said safety bridge over said drain outlets and cementable in place to become a permanent portion of the safety drain; and (g) wherein said upwardly extending positioning keyways are cone shaped and extend outwardly from a sidewall, and wherein said safety bridge keying surfaces are cone shaped and are insertable and snappable into place in the enclosure between the sidewalls with the keying surfaces mating with the corresponding keyway.

* * * * *